United States Patent [19]

Gloeckler

[11] Patent Number: 4,479,368

[45] Date of Patent: Oct. 30, 1984

[54] PROGRAMMABLE KNITTING MACHINE

[75] Inventor: Alfred Gloeckler, Mulhouse, France

[73] Assignee: Superba S.A., Mulhouse, France

[21] Appl. No.: 419,212

[22] Filed: Sep. 17, 1982

[30] Foreign Application Priority Data

Sep. 28, 1981 [FR] France ..... 81 18239

[51] Int. Cl.[3] ..... D04B 7/00; D04B 15/66

[52] U.S. Cl. ..... 66/75.2

[58] Field of Search ..... 66/75.2; 112/158 E

[56] References Cited

U.S. PATENT DOCUMENTS

| | | | |
|---|---|---|---|
| 3,776,003 | 12/1973 | Krause | 66/75.2 |
| 3,805,558 | 4/1974 | Protti | 66/75.2 |
| 3,995,453 | 12/1976 | Gloekler | 66/75.2 |
| 4,142,472 | 3/1978 | Soeda et al. | 112/158 E |
| 4,154,178 | 5/1979 | Brown et al. | 112/158 |
| 4,156,355 | 3/1979 | Rogers et al. | 66/75.2 |
| 4,311,029 | 1/1982 | Sommer et al. | 66/75.2 |

*Primary Examiner*—Ronald Feldbaum

*Attorney, Agent, or Firm*—Thomas H. Murray; Clifford A. Poff

[57] ABSTRACT

(a) A programmable knitting machine (b) Machine comprising a matrix formed of conductors ($A_1$) intersected by conductors ($B_j$) at a point of intersection ($T_{ij}$), display means (4), means (11, 12, 15, 16) for bringing the conductors ($A_i$ and $B_j$) into contact, and a microprocessor.

(c) The invention concerns the programming of knitting machines.

6 Claims, 4 Drawing Figures

PROGRAMMABLE KNITTING MACHINE

The present invention concerns a programmable knitting machine including at least one grooved holder to receive transversely sliding needles which are activated by a carriage displacable in the longitudinal direction of the holder, this carriage including means of selecting needles and directing them along different pathways which permit either a jaquard weave or fancy stitching to be carried out, these pathways being created by cams, these means of selection receiving information in the form of electrical signals from a selection device in synchronisation with the longitudinal displacement of the carriage.

In general terms, programmable knitting machines includes an arrangement which permits patterns to be programmed from matrices, programme cards, or mechanical memories.

With the help of programmes, the selection units for the needles are operated dependent on the design to be performed, in synchronisation with the movement of the knitting carriage on the holder.

In more detail, three types of programmable knitting machines exist at present.

1. Machines with contacts,
2. Machines which use diode matrices,
3. Machines which use programme cards,
4. Machines with a mechanical memory.

Machines which are equipped with a matrix of contacts require a mechanical connection to the movement of the knitting carriage to determine whether the contact is open or closed. However, a mechanical arrangement is subject to fatigue or mechanical wear of the contacts which reduces their reliability.

Machines equipped with diode matrices are very expensive because of the cost of the diodes.

Machines which use programme cards require means for reading the card, means for advancing and retrieving the card, as well as tools for programming the card; the machine is therefore complicated to use, of relatively poor reliability, and expensive.

The machines with a mechanical memory register, at the beginning of each row, manual programming of the pattern and repeat this programming along the length of the row. The capacity of such machines is limited because they allow only small patterns to be created; all the rows have to be programmed and it is not possible to form patterns by multiplication of a basic pattern or by symmetry, etc. The object of the present invention is the creation of a programmable knitting machine which overcomes the disadvantages of the known proposals, uses matrices of contacts or of diodes, includes neither programme cards nor a mechanical memory, but permits the direct programming of patterns, line by line, by a simple mechanical pulse, without requiring training in programming, etc., and which is of simple construction, inexpensive, and very reliable.

Accordingly, the invention concerns a machine of the above type characterised in that it includes a microprocessor having a memory, connected to a pattern and knitting stitch coding matrix by an electrical connection having several conductors, which form a first group of conductors, and in which the number of conductors is equal to the number of columns (or lines) of the matrix, a second group of conductors comprising at least one conductor and forming the lines (or columns) of the matrix, each one of them crossing all the conductors of the first group without being in contact with them while the matrix is inoperative, the conductors or the second group all being connected together to a supply line, means of controlling the functions and display means for the means which enable one of the conductors of the first group to be brought into contact with one of the conductors of the second group at one of the points of intersection of the groups of conductors, to bring one of the conductors of the first group and one of the conductors of the second group into contact in order to enter the programme in the memory.

There is therefore obtained a machine in which programming takes place simply, by virtue of a matrix which is inexpensive to produce. This matrix has the advantage of permitting programming of the design or pattern in a very representative manner since the contacts to be established at different points of the matrix correspond in position to the stitches of the knitting. The operator is therefore enabled in a simple manner actually to see the design or pattern at the time of programming. This avoids difficulties in programming and also mistakes.

In the simplest case, for an experienced operator, the second group of conductors may be limited to a single conductor; this permits one line of the pattern to be programmed, then the operator moves on to programming the following line by always using the same line of the matrix.

However, in the general case, it is preferred that the number of lines of the matrix correspond to the maximum capacity of the part of the memory of the microprocessor which is reserved for this programme. In this case, the operator also advances the microprocessor to programme each line in succession but she has the advantage of being able actually to see the whole of the design during the course of programming.

According to another characteristic, the points of intersection of the conductors are push-buttons.

The method of operation of the contacts at different points in the matrix is very simple and is applied to two possible cases below.

According to another characteristic, the matrix is formed of a support provided with conductors of the first group, an insulating mask covering the conductors and provided with holes at points of intersection of the matrix, this insulator being itself covered by a flexible support carrying the conductors to the second group which cross the conductors of the first group to the right of the points of the matrix, this support being itself covered by a flexible insulating material and the thus-formed assembly is covered by a cover provided with holes to the right of the points of the matrix to permit the introduction of mechanical means for bringing the conductors into contact with the chosen points of the matrix via the holes.

This construction of the programming or coding matrix is particularly useful in practice because in this case it is sufficient to use a rod or a pencil to actuate the points of the matrix.

According to another very useful characteristic, in this construction the cover is rigid and permits the existence of a space between it and the insulating material for the introduction of a recording sheet which becomes marked on introduction of the mechanical means to correspond to the programmed pattern.

The operator, using a pencil, obtains in the course of or at the end of programming a record of the programming of the design and can immediately check it.

The programming and its operation as well as the use of this programme in the course of knitting are considerably simplified by the display means which is formed by a digital display unit, with two displays giving the direction of knitting and one sonic indicator actuated by the correct programming of a point of the matrix.

Finally, according to another characteristic, the control means for the functions comprise on the switching controls, the advancement of the programme of the groups and of the lines, erasure of the programme, initiation of the pattern and the grouping and the programming.

The present invention will be described in greater detail with the aid of the attached drawings in which.

Figure 1:
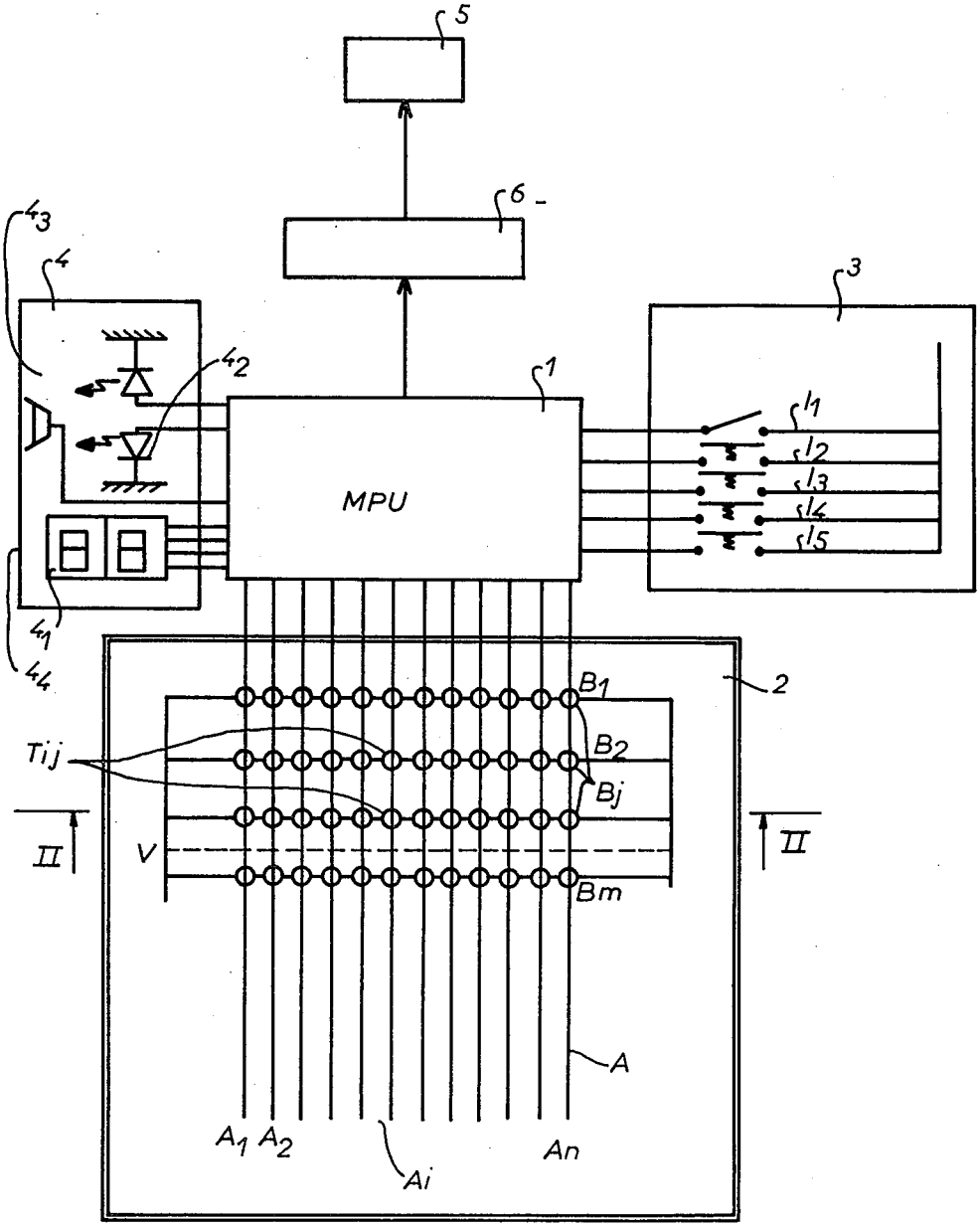
FIG. 1 is a schematic block diagram of the programming apparatus of a knitting machine according to the invention.

According to FIG. 1, the programmable knitting machine of which only the programming means has been shown, comprises a microprocessor 1 connected to a programming matrix 2, to a function selector 3, to a display means 4 and to a needle selection unit 5 by means of an outlet interface 6.

The matrix 2 for the introduction of the data comprises an assembly of conductors $A_1$, $A_2 \ldots A_i \ldots A_n$ connected to a microprocessor 1. The matrix also comprises conductors $B_1$, $B_2$, $B_j \ldots B_m$ which intersect the conductors $A_1 \ldots A_m$ without, however, touching them under normal conditions. The point of intersection of the conductors $A_i$ and $B_j$ is the point $T_{ij}$.

The conductors $A_1 \ldots A_n$ are distinct and are connected to the microprocessor 1. On the other hand, the conductors $B_1 \ldots B_m$ are all connected to the terminal at a common voltage V.

By mechanical actuation, that is to say by pressing on the point of intersection $T_{ij}$, contact is established between the conductor $A_i$ and the conductor $B_j$, which sends a corresponding impulse via the conductor $A_i$ to the microprocessor 1 which enters it in the memory.

Although in theory it would be sufficient to have a single line $B_1$ to achieve line-by-line programming, it is preferred, so that the use of the data entry matrix 2 should be simplified, effectively to provide as many lines $B_m$ on the matrix 2 as there are line programming possibilities in the microprocessor 1. In a general manner, the expressions "lines" and "columns" are interchangeable although in the particular case which is being described, the columns occupy a privileged position; this role could without any modification be played by the lines.

The user can thus programme his pattern on as many of the lines $B_1$, $B_2 \ldots$ as the design requires rows of knitting, and over a width of columns $A_1$, $A_2 \ldots$ corresponding to the width of the design or pattern.

In this regard, it is useful to note that in following the designs, it is necessary to leave a space between two successive designs. In this case the expressions "width" and "height" of the design do not signify the actual width and height of the pattern which makes up the design, but the height and width of the rectangle into which the design fits, including the rows and the stitches which separate two consecutive designs. In this case, the stitches which actually correspond to the design do not represent all the columns and in the same way the rows do not represent all the rows in the design rectangle.

Figure 2:
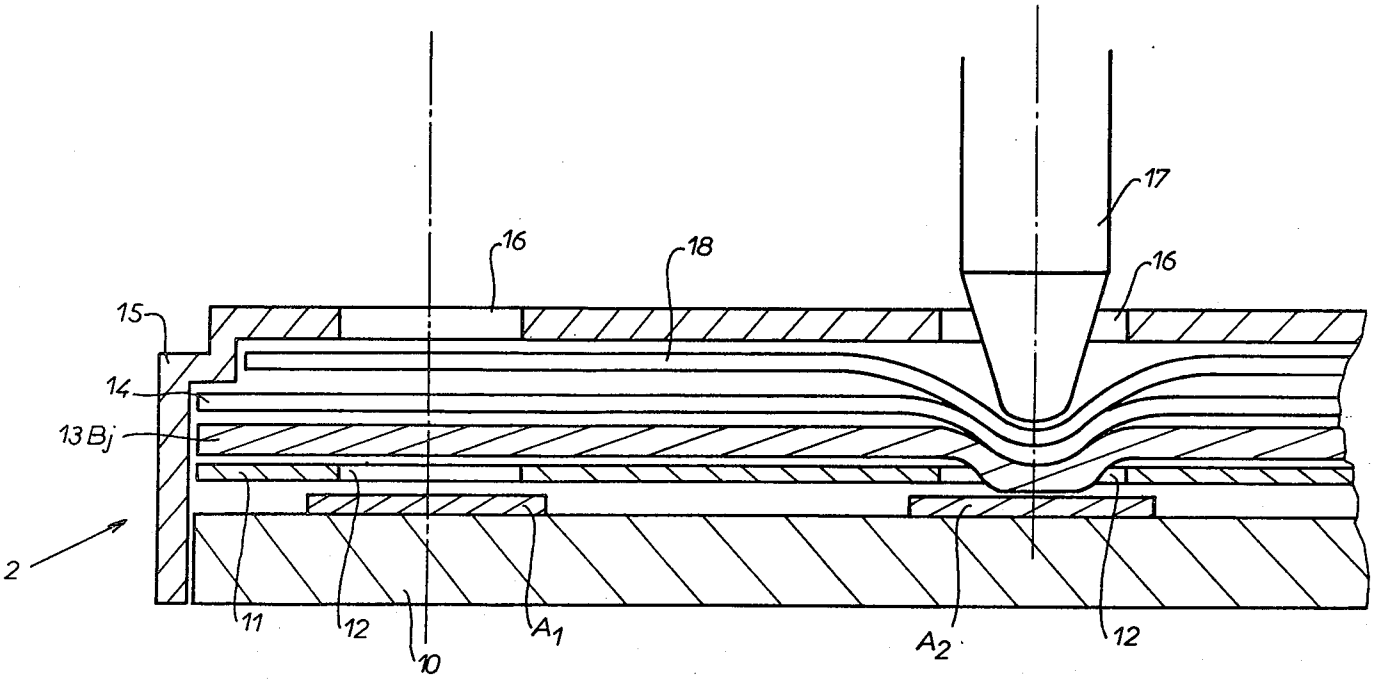
FIG. 2 is a schematic cross-sectional view taken along line II—II of FIG. 1, greatly enlarged, of the programming matrix.

As shown in FIG. 2, the data introduction matrix 2 consists of a base support 10 carrying the conductors $A_1$, $A_2 \ldots$. Above the conductor $A_1 \ldots$ is located a mask 11 which forms a screen and is provided with holes 12 aligned with the conductors $A_1$, $A_2 \ldots$. The centers of the holes 12 correspond to the points of intersection $T_{ij}$ shown in FIG. 1.

The electrically insulated mast 11 is covered by a support 13 which carries the conducting pathway $B_1 \ldots B_3$, which cross the conductors $A_1$, $A_2 \ldots$.

The support 13 is itself covered with an insulating sheet 14. The assembly thus formed is covered by a mask which forms a cover 15 provided with holes 16 which are vertically aligned with the holes 12. The arrangement of the various elements which make up the data introduction matrix 2, in the rest position, is that which is shown in the left hand portion of FIG. 2.

The right hand portion of this figure shows the arrangement of the various elements when effected by pressure exercised by means such as a pencil or in more general terms a pointed instrument 17, which is introduced into the hole 16 and presses on the layers 13, 14 in order to deform the corresponding part of the conductor $B_j$ of the layer 13 through the hole 12 in order to come into contact with the conductor $A_2$.

FIG. 2 also shows a record sheet 18 placed on the upper surface of the cover 15, above the insulating sheet 14. When the instrument 17 is a pen or pencil, etc. the action of penetration of the layers (as in the right hand portion of FIG. 2) leaves a mark corresponding to the hole 16 concerned, the user of the knitting machine can thus ensure by simple visual examination that a unit of data (switch) has been introduced at the corresponding point.

Figure 3:
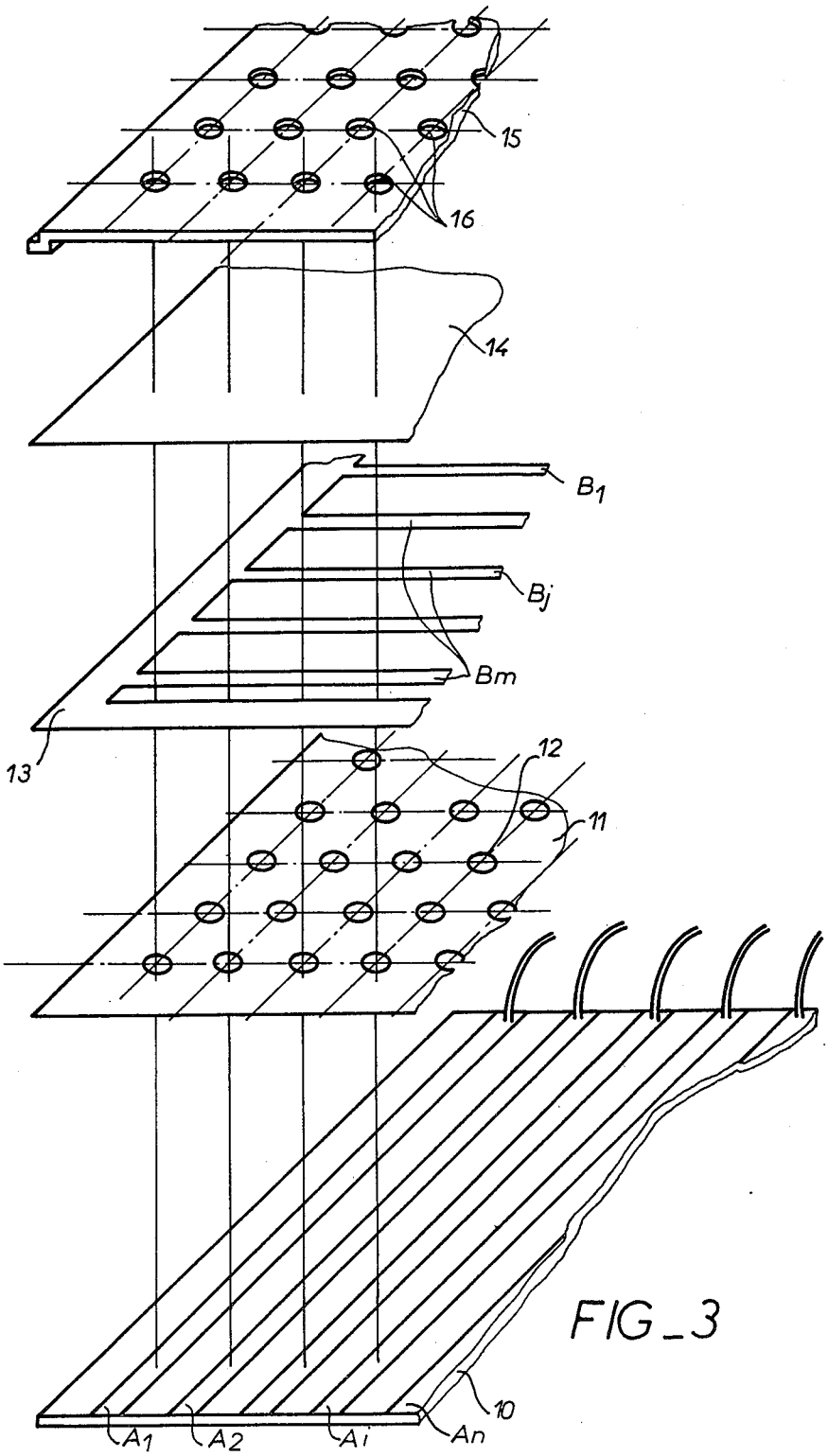
FIG. 3 is an exploded view of the matrix of FIG. 2.

FIG. 3 is an exploded view of the data introduction matrix 2 as shown in FIG. 1 and 2.

This exploded figure shows the support 10 for the conductive pathways $A_1 \ldots A_i \ldots A_n$, of the sheet forming the screen 11 which is perforated by the holes 12, of the support 13 for the transverse conductive pathways $B_1 \ldots B_j \ldots B_m$, of the insulating sheet 14 and of the cover 15 which is provided with holes 16. Sheet 18 shown in FIG. 2 has not been removed.

This figure shows clearly the positioning of the holes 12, 16 at the points of intersection of the conductive pathways $A_1 \ldots A_m$ and $B_1 \ldots B_m$.

Figure 4:
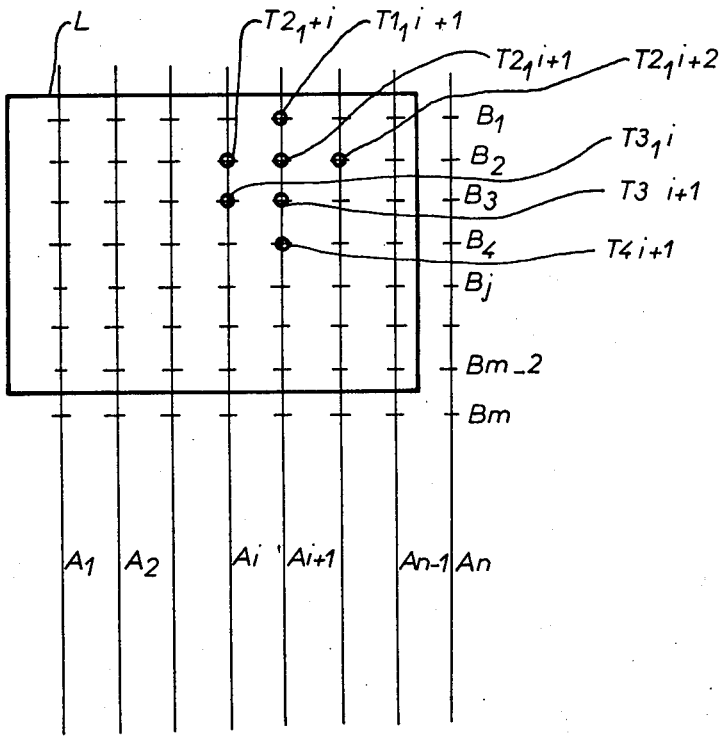
FIG. 4 is a schematic plan view of the matrix showing the record of a programme pattern.

FIG. 4 shows a data introduction matrix having n columns $A \ldots A_n$ and m lines $B_1$, $B_2 \ldots B_m$. The format of the design which has been retained in this example corresponds to a notional rectangle which circumscribes the pattern of the design and of a height included between lines $B_1$ and $B_{m-2}$ and the columns included between the columns $A_1$ and $A_{n-1}$. The pattern strictly-speaking of the design is composed of points $T_{i,i+1}$, $T_{2,i}$, $T_{2,i+1}$, $I_{2,i+2}$, $T_{3,i}$: $T_{3i+1}$, $T_{4\,i+1}$.

In a schematic manner, during knitting, there will be rectangles of dimensions corresponding to those of the rectangle 1 above and inside each rectangle there will be the pattern shown. As the stitches other than those which correspond to the programmed points are identical, the boundaries of the rectangle will not be visible. This manner of surrounding a pattern by a notional rectangle is called in the following description "grouping function".

The apparatus according to the invention also includes a control circuit 3 composed schematically of switches or impulse push-buttons $i_1 \ldots i_5$ to control the functions of the microprocessor 1.

The switch $i_1$ is a toggle switch which, in the open position, permits the matrix 2 to be used to introduce data, in other words the position of the stitches to be knitted: when the switch is in its first position, each time that contact is made between the conductors $A_1$, $A_j$, an electrical signal corresponding to the switch to be made for the corresponding row is entered into the memory.

When the switch $I_1$ is in a second position, it is the opposite data which is introduced into the memory; in other words in the second position, the stitches which correspond to points $T_i$, $T_j$ which will not have been marked by means of the matrix 2.

The function of the switch $I_2$ is to advance by one state the programmes of the groupings and the programmes of the lines. When the apparatus is in the operative position, as will be explained below, activation of the switch $I_2$ orders the advance of one line or of one column.

Thus in order to choose a grouping or a rectangle having four lines and five columns, the switch $I_2$ is depressed four times when the data entering means is in a position to enter functions, thus under the same conditions, the switch push button $I_2$ is depressed five times in order to introduce the five pulses which correspond to the second dimension of the rectangle L.

On the other hand, when the data entering apparatus is in a condition for the entering of data and not in the position for the entering of functions, this switch $I_2$ has the purpose of passing from one line $B_j$ to the following line, at the end of the programming of each line.

This function of the switch $I_2$ is necessary in order to arrive at a matrix having a simple structure, connected only by the lines $A_n$ to the microprocessor 1 and not be lines $A_n$ and lines $B_1$, $B_n$. Thus, at the beginning of the entering of data, the switch $I_2$ is operated so that it locates on the first line $B_1$; the various points $T_{i,1}$ are programmed depending on the design,, then when this entering of the stitching points has been completed, the switch $I_2$ is operated to pass on to the following line $B_2$, this line is then programmed, and so on.

The switch $I_3$ allows a programme to be erased. It is thus possible to modify the grouping or the programming of the lines of the pattern after having depressed the switch $I_3$.

The switch $I_4$ is used to initiate the pattern. For this purpose, there is used a pointer located with regard to the point of selection of the apparatus integrated into the carriage which selects the needle. It is therefore possible to locate the carriage opposite the selected needle for the beginning of the pattern, then to register this position so that the microprocessor 1 calculates backwards the stitches which it is necessary to make at the beginning of the corresponding line. Once this data has been entered, the knitting can take place normally without any necessity to stop the machine or, in general terms, to locate on the knitting the place where the pattern should begin.

This function is necessary when the knitting comprises designs which are to be centered on an axis of symmetry or of which repetition must be symmetrical or, more generally, organised.

The switch $I_5$ has the purpose of passing from the vertical grouping and registering function and the horizontal grouping and registering the function of programming the pattern and further of passing to the signal-treating function.

The display means 4 comprises a display unit 41 with two digits as well as the two luminous direction-indicating display means 42, 43 and the sonic indicator 44. The display unit 41 can display digits or symbols at the time of entering of the data or during running of a programme which has been previously entered. The two display units 42, 43 are electrolminescent diodes which indicate the direction of knitting.

The sonic indicator 44 emits a sonic signal after each operation of a point of the matrix 2 at the time of introduction of the data or at the time of control of operation, in order to confirm correct entering.

Finally the interface 6 and the selection units 5 are for the selection of knitting needles dependent upon the knitting programme formed by the memory of the microprocessor 1.

The entering of a pattern programme, then use of the programme for knitting, is carried out under the following conditions:

In order to introduce a programme, it is sufficient to connect up the power supply of the apparatus which is then ready to receive grouping data (rectangle L).

At first the apparatus automatically takes up the position to receive the horizontal grouping:

The corresponding sign appears on the display unit 41. By sending impulses by means of the switch $I_2$ the position which appears on the display unit 41 is selected in digital form corresponding to the selected horizontal dimension which is then recorded in the memory.

Then, vertical grouping is carried out in a similar manner.

When the group has been finished, the pattern proper is programmed and the various particular functions of treating the signals, for example multiplication of the dimensions of the pattern by two ($x_2$), repetition of the pattern about a vertical axis of symmetry ($S_v$), or repetition of the pattern about a horizontal axis of symmetry ($S_h$).

I claim:

1. In a programmable knitting machine including at least one grooved holder for receiving transversely-slideable needles activated by a carriage which is displaceable in the longitudinal direction on the holder, the carriage comprising means for selecting and directing needles along various pathways either for jacquared weaving or fancy stitching, the improvement comprising a microprocessor having a memory connected to a pattern and knitting coding matrix by an electrical connection including several conductors forming a first group of conductors, the number of conductors comprising the first group being equal to the number of columns or lines of said matrix, said electrical connection further including a second group of conductors forming the lines or columns of said matrix crossing each one of the conductors of the first group without being in contact therewith when the matrix is inoperative, a common electrical supply line interconnected with each of the conductors of the second group of conductors, needle selection means responsive to an output signal from said microprocessor, selector means for controlling input functions to said microprocessor including line-by-line programming by a signal from said matrix at each point where contact is established between a conductor of the first group and a conductor of the second group, and display means for indicating the programmed memory of said microprocessor by said pattern and knitting coding matrix.

2. The machine according to claim 1 wherein said matrix includes means for interconnecting the conductors of said first and second groups of conductors.

3. The machine according to claim 1 wherein said matrix includes a support bracket for said first group of conductors, an insulating mask covering said first group of conductors, said mask having holes at the points of interconnection of the first and second groups of conductors, a flexible support covering said insulating mask for carrying the conductors of the second group, a flexible insulating sheet covering said flexible support, and a cover provided with holes for establishing said points of interconnection of the matrix to permit the introduction of a mechanical member to bring the conductors of the first and second groups into contact at selected points of the matrix.

4. The machine according to claim 3 wherein said cover is rigid and forms a gap with said flexible insulating sheet, said machine further including a record sheet in said gap to receive markings corresponding to the programmed pattern.

5. The machine according to claim 1 wherein said display means includes two displays for indicating the direction of knitting, and a sonic indicator responsive to a programmed point of said matrix.

6. The machine according to claim 1 wherein said selector means includes a programming control for advancing programmed groups and lines from said matrix to said microprocessor, an erase control for a program in the microprocessor, an initiating control for a pattern, and a control for grouping and programming signals fed from the matrix to the microprocessor.

* * * * *